United States Patent [19]

Mc Elwain

[11] 3,960,372

[45] June 1, 1976

[54] PUNCH PRESS

[75] Inventor: James A. Mc Elwain, Niagara Falls, N.Y.

[73] Assignee: Houdaille Industries, Inc., Buffalo, N.Y.

[22] Filed: Aug. 27, 1974

[21] Appl. No.: 500,874

[52] U.S. Cl. ..... 269/320; 83/391

[51] Int. Cl.[2] ..... B26D 7/16

[58] Field of Search ..... 269/315, 317, 326; 83/391, 58

[56] References Cited

UNITED STATES PATENTS

| | | | |
|---|---|---|---|
| 2,620,688 | 12/1952 | Hull | 269/315 |
| 2,773,299 | 12/1956 | Mack | 269/315 X |
| 3,133,648 | 5/1964 | Heyne | 269/317 X |
| 3,262,695 | 7/1966 | Fowler et al. | 269/317 |
| 3,626,796 | 12/1971 | Pearl | 83/58 |
| 3,815,462 | 6/1974 | Kaufmann | 83/410 |

*Primary Examiner*—Al Lawrence Smith
*Assistant Examiner*—James G. Smith
*Attorney, Agent, or Firm*—Hill, Gross, Simpson, Van Santen, Steadman, Chiara & Simpson

[57] ABSTRACT

A punch press is provided with a side gage member for fixing the location of the workpiece in the X-axis preparatory to being clamped to moving means which position the workpiece in various positions with respect to the punching axis. The side gage member includes adjustment means for accurately setting the distance between its gaging surface and the centerline of the die.

11 Claims, 3 Drawing Figures

PUNCH PRESS

BACKGROUND OF THE INVENTION

1. Field of the Invention

This invention relates to punch presses, and more specifically to gaging used to locate a workpiece with respect to the die and hence with respect to a previously prepared program of punch press operation.

2. Prior Art

Various types of gaging have been provided on punch presses to orient a workpiece with respect to a program of press operations. The problem is to get an exact precise dimension of predetermined size between the gaging surface and the centerline of the die. For example, at typical dimension is 48.000 inches plus or minus 0.0005 inch. Thus with such a dimension, the entire range of permissible locating errors is only one part in 48,000. During usage, wear becomes an immediate problem necessitating removal, grinding and shimming. Further, prior X-axis gaging has been so constructed as to be virtually specialized for a specific punch press construction.

SUMMARY OF THE INVENTION

According to the invention, a side gage member is carried on the means that moves the workpiece and is movable between extended and retracted positions for engaging or clearing the workpiece, to coordinate the position of the workpiece when grasped by the moving means with a built-in punching program.

Accordingly, it is an object of the present invention to provide a punch press having improved gaging structure for initial X-axis gaging.

Another object of the present invention is to provide initial X-axis gaging structure which is adjustable so that its effective location can be readily adjusted during initial assembly and after subsequent wear.

Many other advantages, features and additional objects of the present invention will become manifest to those versed in the art upon making reference to the detailed description and the accompanying drawings in which a preferred structural embodiment incorporating the principles of the present invention is shown by way of illustrative example.

ON THE DRAWINGS

AS SHOWN ON THE DRAWINGS

Figure 1:
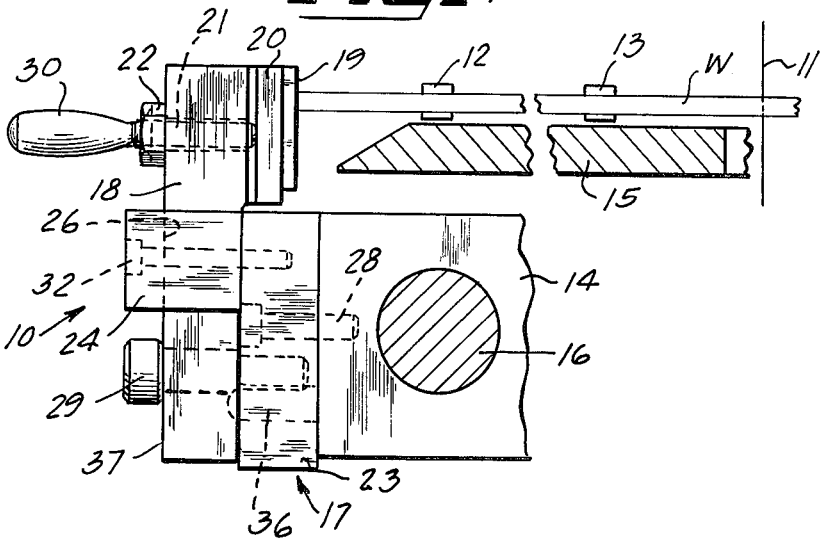
FIG. 1 is a fragmentary cross sectional view partly diagrammatic, along a vertical plane.

The principles of the present invention are particularly useful when embodied in an X-axis side gage assembly for initial gaging illustrated in FIG. 1, generally indicated by the numeral 10.

The assembly 10 may be associated with various types of punch presses of the type that are automatically controlled by a numerical control. One such punch press is shown in U.S. Pat. No. 3,350,088 which has a single pair of tools therein; another type of press being shown in U.S. Pat. No. 3,815,462 which includes a pair of turrets for tooling; and a third type of punch press is shown in U.S. Pat. No. 3,405,581 wherein the support table is movable in the Y-axis. In the other two patents, the motorized moving means which have clamps for holding the workpiece are movable in the Y-axis, toward and away from the centerline of the die. As punch presses of these types are known, there is shown in FIG. 1 in a schematic or diagrammatic way, only certain portions of a representative punch press. The press includes relatively reciprocable punch and die tooling which has a centerline 11 with respect to which the numerically controlled program is operative. A workpiece W is held by a pair of clamps 12, 13 secured to motorized moving means 14 by means omitted herein. (As shown in U.S. Pat. No. 3,350,088, the motorized moving means 14 hereof is movable in the horizontal Y-axis on side rail means 16 and has a portion (not shown herein) which extends in the horizontal X-axis across the table 15 on which a workpiece holder (not shown herein) is supported for movement in the X-axis and to which the clamps 12, 13 are secured.) The motorized moving means is thus adapted to be clamped to the workpiece for moving the workpiece in the X and Y axes in a plane perpendicular to the punching axis 11. Typically, a workpiece supporting table 15 is included and the moving means 14 is supported such as by a pair of rails 16 disposed at opposite sides of the workpiece supporting table 15.

According to the invention, there is provided a mounting bracket 17 to which is pivoted a side gage member 18 having a gaging surface 19 carried on a spring blade 20, the position of which is selectably determined by the setting of an adjustment screw 21 which is held in a selected place by a lock nut 22.

Figure 2:
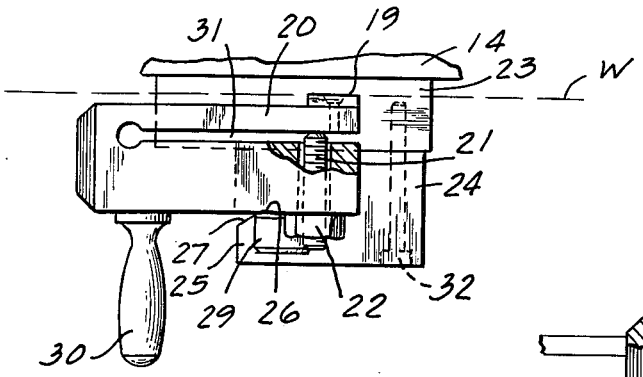
FIG. 2 is a top view of the structure of FIG. 1 with a workpiece and table omitted.
Figure 3:
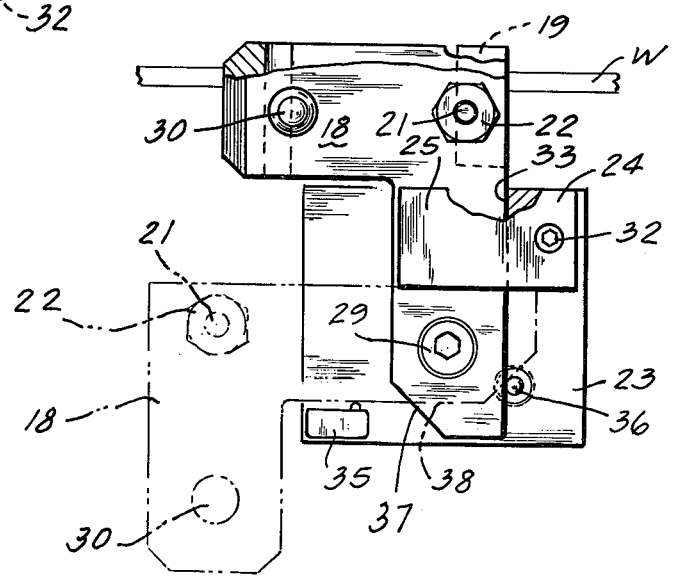
FIG. 3 is a side view of the structure of FIG. 1 with the table omitted and with certain switches shown diagrammatically that are not shown in the other views.

The bracket 17 includes a base 23 which appears square in FIG. 3 to the face of which is secured an L-shaped arm 24. One leg of the arm 24 is in direct engagement with the base 23 and the other arm 25 extends in spaced parallel relation to the base 23 to define therewith a slot 26. The slot 26 snugly receives an intermediate portion of the side gage member 18, and to enable such reception, the mounting bracket 17 is beveled at 27 as shown in FIG. 2. The mounting bracket 17 is secured as by a screw 28 to the moving means 14 and thus pivotably supports the side gage member 18 by a pivot screw 29. In the event that the pivotal connection becomes worn or is loose, such condition does not affect the position of the gaging surface 19 because of the snug fit between the side gage member 18 and the mounting bracket 17 in the slot 26, such fit being snug in the direction of the predetermined distance between the gaging surface 19 and the punching axis 11.

The side gage member 18 for convenience is provided with a handle 30 to enable it to be pivoted from the upper extended position shown in solid lines in all three views to the position shown in the chain line in FIG. 3. In the upper position, the gaging surface 19 intersects the plane in which the workpiece W is moved horizontally by the moving means 12–14, while in the lower or retracted position shown in FIG. 3, the side gage member 18 is disposed fully below the upper surface of the table 15 to enable unrestricted horizontal movement of the workpiece W.

As best seen in FIG. 2, the spring blade 20 is integral with the side gage member 18 at one end and at the other end carries a hardened element that provides the gaging surface 19. The spring blade 20 is provided by means of the provision of an elongated slot 31 which is spanned by the adjustment screw 21.

The arm 24 is secured to the base 23 by a number of screws 32 only one of which is illustrated. As shown at 33, the inner end of the slot 26 also serves to define the extended or upper limit of pivotal travel of the side gage member 18, a position which is sensed by a switch 34 (not shown), its lower retracted position being sensed by a switch 35 (also shown with its plunger depressed). The switch 34 is connected in electrical circuit with the punch press and is controlled to prevent or inhibit punching movement so long as the side gage member 18 is raised. The switch 35 is connected to enable punching operation of the press after the side gage member 18 has been fully retracted. The illustration of the switches 34,35 is diagrammatic in location and not structural.

Detent means are provided to hold the side gage member 18 in the upper and lower positions, the detent means here comprising a single spring loaded ball 36 which acts either on a portion 37 or a portion 38 of the side gage member 18.

A preferred form of setting the adjustment means 21 is to tighten the screw 21 against the spring blade 20 so as to tension the same against the screw 21, leaving the locating surface 19 at a distance which is slightly in excess of the predetermined or calibrated distance desired between such surface 19 and the centerline 11. Thereafter, the adjustment screw is further tightened until the gaging surface 19 is within the tolerance range permitted, and is still further tightened to bring it to the low end of the tolerance, and locked. Then as wear takes place as a consequence of the engagement of workpieces with the surface 19, the abutment point of wear moves gradually into the tolerance range. When this range of about 0.001 inch has been used up by wear, the adjusting screw 21 is once more advanced as described above, and locked. This gage therefore provides a location on the left-hand side of the punching axis to determine the setting of the workpiece in the X-axis with respect to the precision punching program contained within the automatic numerical controls. By this structure, no removal or rework or shimming is necessary to keep the structure within tolerance.

Although various minor modifications might be suggested by those versed in the art, it should be understood that I wish to embody within the scope of the patent warranted hereon, all such embodiments as reasonably and properly come within the scope of my contribution to the art.

I claim as my invention:

1. In a punch press having a vertical punching axis, the combination comprising:

a. means adapted to be clamped to a workpiece for moving the workpiece in the X and Y axes in a horizontal plane intersecting the punching axis;

b. a side gage member carried on said moving means and movable between an upper extended position intersecting said horizontal plane and a retracted position below said plane, said side gage member having a gaging surface which, in at least said extended position, is horizontally spaced by a predetermined distance in the X-axis from a vertical plane, extending through the punching axis and parallel to the Y-axis, for precisely positioning an edge of the workpiece, at said predetermined distance for the workpiece then being clamped to said moving means.

2. A punch press according to claim 1 including a mounting bracket secured to said moving means and supporting said side gage member, there being a slot in said mounting bracket receptive of said side gage member with a snug fit in the direction of said X-axis.

3. A punch press according to claim 1 including a mounting bracket on which said side gage member is pivotally supported for movement to said extended and retracted positions.

4. A punch press according to claim 1 including a mounting bracket on which said side gage member is movably mounted for movement to said extended and retracted positions, and detent means acting between said mounting bracket and said side gage member for holding said side gage member in said positions.

5. A punch press according to claim 1 in which said side gage member has a spring blade on which said gaging surface is located, and an adjustment screw acting between said side gage member and said spring blade for precisely setting said predetermined distance.

6. A punch press according to claim 4 in which said detent means comprises a single spring loaded ball acting respectively on two spaced portions of said side gage member.

7. A punch press according to claim 5 in which said spring blade is integral with said side gage member and is defined by an elongated slot spanned by said adjustment screw.

8. A punch press according to claim 5 in which said adjustment screw acts on said spring blade at the unsupported end thereof.

9. A punch press according to claim 1 including a workpiece-supporting table over which said moving means extends, and along opposite sides of which said moving means is supported, said side gage member being supported below the height of said table and being disposed entirely below the height of said table in its retracted position.

10. A punch press according to claim 1 including switch means responsive to the position of said side gage member and adapted to be connected to respectively inhibit and to enable operation of the punch press.

11. A punch press according to claim 1 including adjustment means acting to position a gaging surface on said side gage member relatively to said moving means for accurately setting said predetermined distance.

* * * * *